US007125368B2

(12) United States Patent
Endelman

(10) Patent No.: US 7,125,368 B2
(45) Date of Patent: Oct. 24, 2006

(54) REFORMER EXERCISE APPARATUS HAVING A NON-ROTATING SPRING ANCHOR BAR

(75) Inventor: Ken Endelman, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 385 days.

(21) Appl. No.: 10/690,679

(22) Filed: Oct. 21, 2003

(65) Prior Publication Data

US 2005/0085357 A1 Apr. 21, 2005

Related U.S. Application Data

(63) Continuation-in-part of application No. 10/028,497, filed on Dec. 20, 2001, now Pat. No. 6,685,606.

(51) Int. Cl.
*A63B 26/00* (2006.01)

(52) U.S. Cl. ..... 482/142; 482/121

(58) Field of Classification Search ..... 482/121, 482/133, 139, 142, 907, 70–72, 95–96, 135, 482/52–54; D21/690
See application file for complete search history.

(56) References Cited

U.S. PATENT DOCUMENTS 1,738,987 A * 12/1929 Dattilo ..... 482/72
4,706,953 A 11/1987 Graham
4,884,802 A 12/1989 Graham
5,066,005 A 11/1991 Luecke
D362,700 S 9/1995 Breibart et al.
5,607,381 A 3/1997 Endelman
5,681,249 A 10/1997 Endelman
5,792,033 A 8/1998 Merrithew ..... 482/96
6,186,929 B1 2/2001 Endelman et al. ..... 482/121
6,338,704 B1 1/2002 Endelman ..... 482/142
6,685,606 B1 * 2/2004 Endelman ..... 482/142
2003/0119636 A1 6/2003 Endelman

* cited by examiner

*Primary Examiner*—Lori Amerson
(74) *Attorney, Agent, or Firm*—Greenberg Traurig LLP

(57) ABSTRACT

A reformer exercise apparatus has a generally rectangular frame and a pair of spaced-apart parallel tracks or rails joining a head end and a foot end. A movable carriage is mounted on the frame for movement of the carriage along the rails. A pair of spaced-apart anchor bar supports formed integrally with the tracks is fastened near the foot end of the frame and each supports an end of a nonrotating spring anchor bar. Each bar support has a series of upwardly open slanted slots, and the anchor bar is received in a selected pair of the slots. The cross section of each anchor bar end is shaped to engage the slot walls to prevent rotation of the anchor bar.

16 Claims, 4 Drawing Sheets

REFORMER EXERCISE APPARATUS HAVING A NON-ROTATING SPRING ANCHOR BAR

This application is a continuation-in-part of U.S. patent application Ser. No. 10/028,497, filed on Dec. 20, 2001, now U.S. Pat. No. 6,685,606, issued Feb. 3, 2004.

FIELD OF THE INVENTION

This invention relates generally to the field of exercise equipment and more particularly to a reformer type exercise apparatus in which a movable carriage for supporting portions of a user's body is connected to one end of a rectangular frame via elastic members.

BACKGROUND OF THE INVENTION

A conventional reformer exercise apparatus includes a wheeled platform carriage, which rides on a rectangular wooden or metal frame. The carriage is connected to a series of parallel elastic members, e.g. springs, which are in turn connected to a foot end of the rectangular frame. The carriage typically rides on parallel rails or tracks mounted to the longer side of the rectangular frame. This carriage has a flat, padded upper surface and typically includes a pair of spaced, padded, upright shoulder stops and a headrest at one end to support the shoulders and head of the user when the user is reclined on the carriage.

An adjustable foot bar, foot support, or foot rest against which the user places his/her feet is mounted at the foot end of the rectangular frame. A spring support rod is positioned across the foot end of the rectangular frame between the tracks and is held in place by a spring support bracket fastened to the frame. The rod typically fits in one of three or four pairs of upwardly open, slanted recesses or slots in the support bracket. Alternatively, the spring support rod may be permanently fastened to the foot end of the frame. The user can typically push against the foot rest to move the carriage along the track away from the foot rest against spring tension to exercise the leg and foot muscle groups of the user's body in accordance with prescribed movement routines.

The spring support rod is typically a cylindrical rod or tube with a circular cross-section. A series of hooks for securing ends of the elastic members or springs are attached in a line along the cylindrical spring support rod. The other ends of the springs are connected to the carriage.

The springs provide resistance for biasing the carriage toward the foot end of the frame. A user can vary the resistance provided by the springs in order, for example, to change the intensity level of the exercise by selecting different combinations of springs. The hooks on the spring support rod allows a user to easily vary the number of springs by providing an easy way to disconnect the springs from the rod and reconnect the springs to the rod received in the slots. The user may also vary the relaxed spring tension on the carriage by changing the pair of slots into which the spring support rod is mounted. The spring support rod, when mounted in the slots nearest the foot end of the frame, for example, provides the maximum relaxed spring resistance.

The circular cross-sectional profile of the spring support rod allows rotational movement of the rod in the slots when the springs are loosely or are not connected to the rod at all. The spring support rod resting in the slots typically rotates (due to gravity) to a position where the hooks are pointed downward when no tension is applied by the springs. This is inconvenient for the user, requiring the use of one of the user's hands to rotate the bar to align the hooks horizontally while the user places the end of the spring on the hook with the other hand.

SUMMARY OF THE INVENTION

A reformer exercise apparatus of the present invention has a generally rectangular frame formed by a foot end and a head end connected to two spaced-apart parallel side frame members. A movable carriage is mounted on the frame for supporting a user and for movement along the side frame members against spring tension from one or more elastic members, such as springs, are fastened between the foot end and the carriage. A pair of spaced-apart elastic member anchor bar support brackets are fastened to the frame near the foot end, and each supports one end of an elongated elastic member anchor bar. One or more of the elastic members are fastened between the carriage and the anchor bar to elastically bias the carriage toward the foot end of the frame.

Each bracket has a series of upwardly open slanted slots. Each slot is generally U-shaped and has a semicircular concave bottom wall portion extended by a pair of spaced parallel sidewall portions. The two bar ends of the elongated anchor bar are configured to prevent rotation of the anchor bar mounted in the slots about its longitudinal axis.

Thus, when all the springs are removed from the hooks, the hooks remain in a horizontal line parallel to the side frame members since the spring anchor bar cannot rotate about its longitudinal axis. This makes it easy for a user to attach various combinations of springs on the hooks of the spring anchor bar using only one hand.

DETAILED DESCRIPTION

Figure 1:
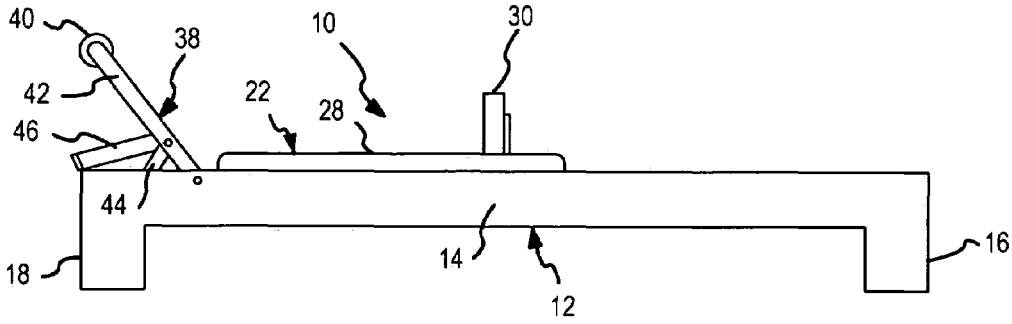
FIG. 1 is a side view of an exercise apparatus incorporating the present invention.
Figure 2:
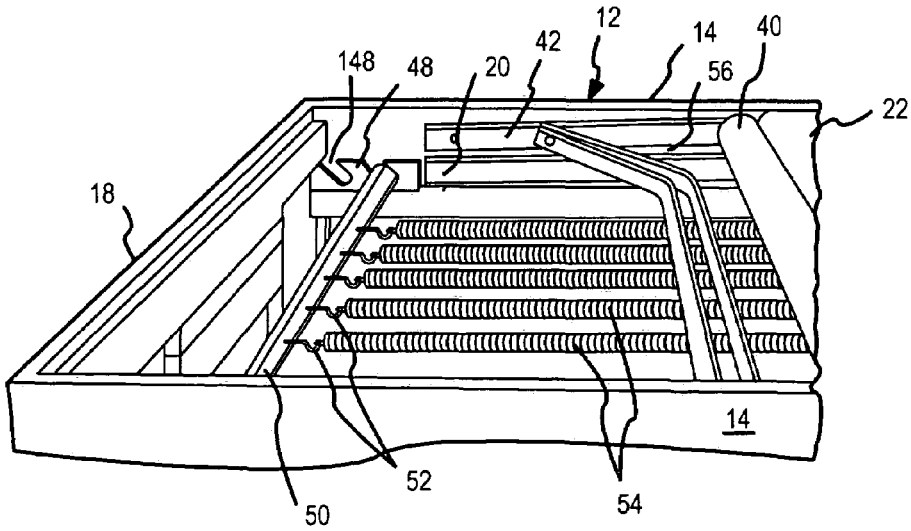
FIG. 2 is a perspective view of the foot end of the apparatus shown in FIG. 1 with the foot rest folded down into the frame and the non-rotating spring anchor bar received in the pair of slots of the spring support bracket.

An exercise apparatus 10 incorporating a preferred embodiment of the present invention is shown with respect to FIGS. 1–2. The exercise apparatus 10 has a generally rectangular frame 12, which has spaced, parallel long sidewalls 14. The head ends of the sidewalls 14 are joined by a head end wall 16, and the foot ends of the sidewalls 14 are joined by a foot end wall 18. Each of the sidewalls 14 carries an inside horizontal rail 20, preferably made of aluminum angle bar stock having an "L" shaped cross section. The rails 20 are bolted or screwed to the inside surfaces of the sidewalls 14 to form a pair of parallel and horizontally spaced tracks upon which a wheeled carriage 22 rides.

The wheeled carriage 22 has a flat rectangular base plate (not shown) and a carriage cushion pad 28, which is fastened on top of the flat rectangular base plate. The carriage cushion pad 28 supports portions of a user's body. The flat rectangular base plate has two pairs of roller wheels (not shown) mounted to its underside at its corners. These roller wheels ride along the rails 20 to constrain movement of the wheeled carriage 22 forward and backward between the head end wall 16 and the foot end wall 18 of the frame 12. A pair of spaced apart shoulder stops 30 and a headrest (not shown) are fastened to the head end of the flat rectangular base plate.

The exercise apparatus 10 includes an adjustable foot bar support assembly 38. The foot bar support assembly 38 preferably has a padded horizontal foot bar 40 that is adjustably positioned above the foot end of the frame 12 via support members 42. Each of the two support members 42 has one end pivotally mounted to the inside of one of the frame sidewalls 14. The support members 42 are positioned at a location spaced from the foot end wall 18 so that the support members 42 and the padded horizontal foot bar 40 may be folded down parallel with the upper edge of the frame 12.

The foot bar support assembly 38 is shown folded toward the foot end of the carriage 22 in FIG. 2 for clarity in description of this invention. The foot bar support assembly 38 further includes a pair of "U" shaped brace members 44, 46. One end of each of the two "U" shaped brace members 44, 46 is pivotally fastened to one of the support members 42 near its midpoint. The other end of each of the two "U" shaped brace members 44, 46 is pivotally fastened to the other support member 42 near its midpoint. These "U" shaped brace members 44, 46 are of different lengths so that they can position the padded horizontal foot bar 40 at different heights above the frame 12 and nest together between the support members 42 and the horizontal foot bar 40 in a folded position as shown in FIG. 2. In this folded position, spring tension can be used to hold the carriage 22 against the horizontal bar 40.

One of a pair of spring anchor bar support brackets 48 and a non-rotating spring anchor bar 50 in accordance with a preferred embodiment of the present invention are shown in FIG. 2. Each spring anchor bar support bracket 48 is mounted at the foot end of each rail 20 and has a series of upwardly open slanted slots 148. One end of the non-rotating spring anchor bar 50 is received inside one of the upwardly open slanted slots 148. The other end of the non-rotating spring anchor bar 50, received in a corresponding slot 148 in the other spring anchor bar support bracket 48, is hidden from view. The upwardly open slanted slots 148 are angled so that the openings of the slanted slots 148 are directed toward the foot end wall 18, that is, away from the ends of the springs 54. In this manner, gravity and the relaxed spring tension securely retains the non-rotating spring anchor bar 50 inside the selected pair of the slanted slots 148.

The embodiment of the non-rotating spring anchor bar 50 illustrated carries a plurality of spaced hooks 52 along its longitudinal axis. These hooks 52 are designed to receive one end of an elastic member such as a spring 54. The other end of the spring 54 is fastened to the underside of the foot end of the wheeled carriage 22 so as to bias the carriage toward the foot end of the frame. All of the springs 54 are shown attached to the hooks 52 in FIG. 2 for illustrative purposes only. A user of the exercise apparatus 10 can vary the spring tension applied to the carriage 22 during different exercise routines by changing the combination of the springs 54 attached to the hooks 52 and/or moving the non-rotating spring anchor bar 50 to the other slot in each of the spring support brackets 48.

Figure 3:
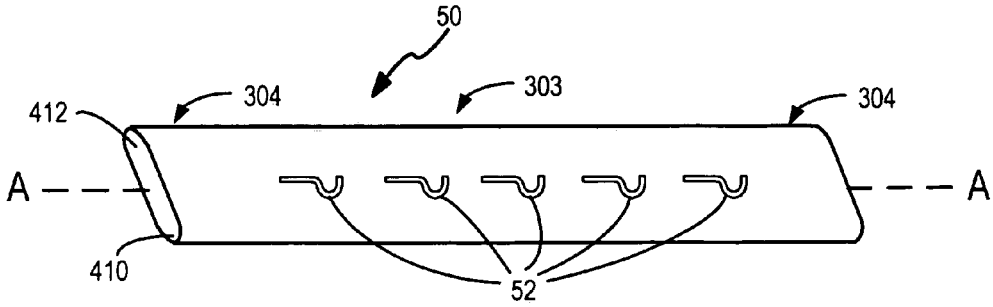
FIG. 3 is a perspective view of the non-rotating spring anchor bar in accordance with a preferred embodiment of the present invention.
Figure 5:
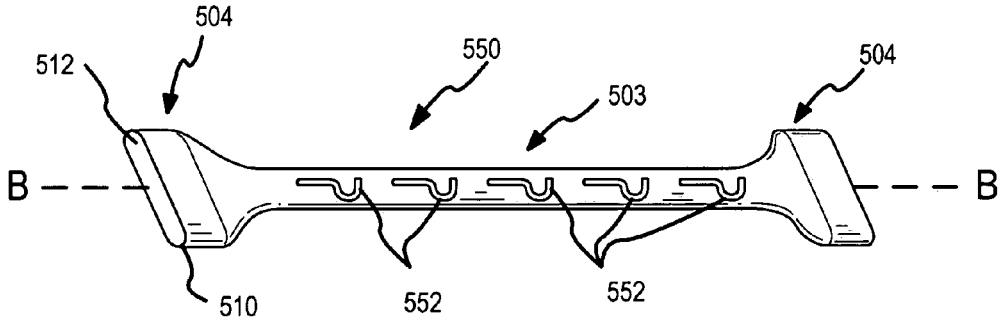
FIG. 5 is perspective view of a non-rotating spring anchor bar in accordance with another embodiment of the present invention.

A separate perspective view of the non-rotating spring anchor bar 50 according to one embodiment of the invention is shown in FIG. 3. The non-rotating spring anchor bar 50 is an elongated bar or tube made from a material such as a metal, plastic, or wood. The non-rotating spring anchor bar 50 can be viewed as having a mid bar portion 303 joining two bar end portions 304. The mid bar portion 303 and the bar end portions 304 of the non-rotating spring anchor bar 50 may share a common exterior shape and together form one elongated bar such as is shown in FIG. 3. Alternatively, the mid bar portion may have a different exterior shape such as is shown in FIG. 5.

Figure 4:
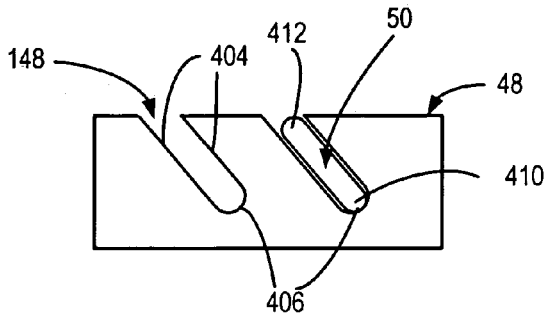
FIG. 4 is an end view of the non-rotating spring anchor bar shown in FIG. 3 received in a pair of slots of the spring support bracket in accordance with a preferred embodiment of the present invention.

The two bar end portions 304 are received in one selected pair of the upwardly open slanted slots 148 of the spring support brackets 48. FIG. 4 shows a side view of the spring support bracket 48 with one bar end portion 304 received in one upwardly open slanted slot 148. Two upwardly open slanted slots 148 are shown to be present in each spring support bracket 48 in FIGS. 2, 4, and 6; however, the total number of the slanted slots 148 in a spring support bracket 48 is a matter of design choice. Typically, there may be three to four slots in each spring support bracket 48.

The bracket 48 has a pair of spaced sidewall portions 404 joining a concave bottom wall portion 406 to form each upwardly open slanted slot 148. Each bar end portion 304 has a convex bottom portion 410 and a stabilizing portion 412. The convex bottom portion 410 has an exterior shape preferably generally complimentary to the concave bottom wall portion 406 of the bracket 48 forming the upwardly open slanted slot 148. The stabilizing portion 412 abuts one or both of the sidewall portions 404 to stabilize the non-rotating spring anchor bar 50 received inside the selected pair of upwardly open slanted slots 148. This configuration prevents any substantial angular rotation of the non-rotating spring anchor bar 50 in the upwardly open slanted slots 148 about the axis A whenever the bar ends 304 are received within a selected pair of slots 148.

As shown in FIG. 4, the anchor bar 50 is prevented from rotating when each of the bar ends 304 is positioned inside one of the selected pair of upwardly open slanted slots 148. The convex bottom portion 410 of the bar end portion 304 is received at the bottom of the upwardly open slanted slot 148 and mates with the bottom concave wall portion 406. The bar end portions 304 are prevented from rotating in either the clockwise or counter clockwise direction since the stabilizing portion 412 of each bar end portion 304 is closely and may be frictionally opposed by the sidewall portions 404 of the slot 148.

The mid bar portion 303 makes no substantial contribution in preventing angular rotation of the non-rotating spring anchor bar 50 about the axis A in the slots 148 beyond rigidly tying the end portions together. Thus, the exterior form or shape of the mid bar portion 303 need not be identical or even similar to the exterior shape of the bar end portions 304 of the non-rotating spring anchor bar 50. As an example, FIG. 5 shows a non-rotating spring anchor bar 550 according to an alternate embodiment of the present invention in which the mid bar portion 503 has an exterior shape different than the exterior shapes of the two bar end portions 504. The mid bar portion 503 is an elongated cylindrical rod (or a tube). The two bar end portions 504 that join the mid bar portion 503 have the same exterior shape as the two bar end portions 304 in the first embodiment of the present invention that is shown in and described with respect to FIGS. 3–4.

Figure 6:
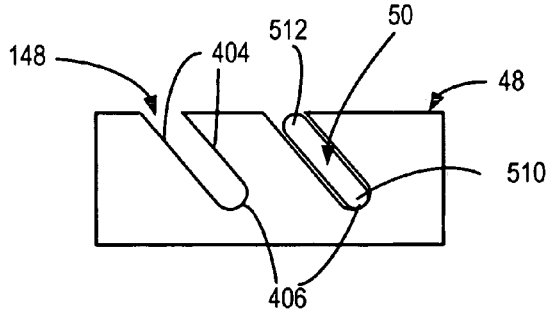
FIG. 6 is an end view of the non-rotating spring anchor bar shown in FIG. 5 received in one of the pair of slots of the spring support bracket.

In a manner similar to the embodiment of the present invention described with respect to FIGS. 3–4, the two bar end portions 504 of the alternate embodiment are sized to be received in one selected pair of the upwardly open slanted slots 148 of the spring support bracket 48. FIG. 6 shows a side view of one bar end portion 504 received in one upwardly open slanted slot 148 of the spring support bracket 48.

Each bar end portion 504 again has a convex bottom portion 510 and a stabilizing portion 512. The convex bottom portion has an exterior shape generally complimentary to the concave bottom wall portion 406 defining the upwardly open slanted slot 148. The stabilizing portion 512 stabilizes the non-rotating spring anchor bar 550 received inside the selected pair of upwardly open slanted slots 148 and prevents substantial angular rotation of the non-rotating spring anchor bar 550 in the upwardly open slanted slots 148 about the axis B whenever the bar ends 504 are received within a selected pair of slots 148. Again, the bar end portions 504 are prevented from rotating in either the clockwise or counter clockwise direction since the stabilizing portion 512 of each bar end portion 504 abuts against the sidewall portions 404 of the slot 148.

In general, the non-rotating spring anchor bar (50 or 550 shown in FIG. 3 or 5) can be made from various materials (e.g., metal, wood, plastic, composite material, etc.) that are either solid or tubular. Further, various exterior shapes are permissible for the mid bar portion 303, 503 (e.g., cylindrical rod, elongated rectangular bar, etc.). More simply, the anchor bar 550 may be made from an aluminum tube by simply flattening the ends of the tube so as to fit within the slots 148. Alternatively, the bar may simply be an extrusion, for example, of aluminum, having an oval shape cross-section with parallel side portions as is shown in FIGS. 3 and 4.

In addition, various shapes of the bar end portions 304, 504 are also permissible so long as they can substantially prevent the non-rotating spring anchor bar (50 or 550) from rotating when the bar end portions 304, 504 are received inside a selected pair of the upwardly open slanted slots 148. Any shape for the bar end portions 304, 504 that achieves this purpose is a suitable shape. For example, it is not a requirement that the bottom portion 410, 510 of the bar end portion 304, 504 must have a convex cross sectional profile that is complementary to the concave cross-sectional profile of the concave bottom wall portion 406 of the slot 148 as shown in FIGS. 4–6 For example, the bottom of each of the slots 148 may be concave as shown or may be square cornered, with the bottom portions 410 and 510 curved as shown or vice versa. The stabilizing portion 412 and 512 may have a different shape so long as it engages with the sides 404 of the slot 148 to prevent rotation of the anchor bar 50 or 550.

Figure 7:
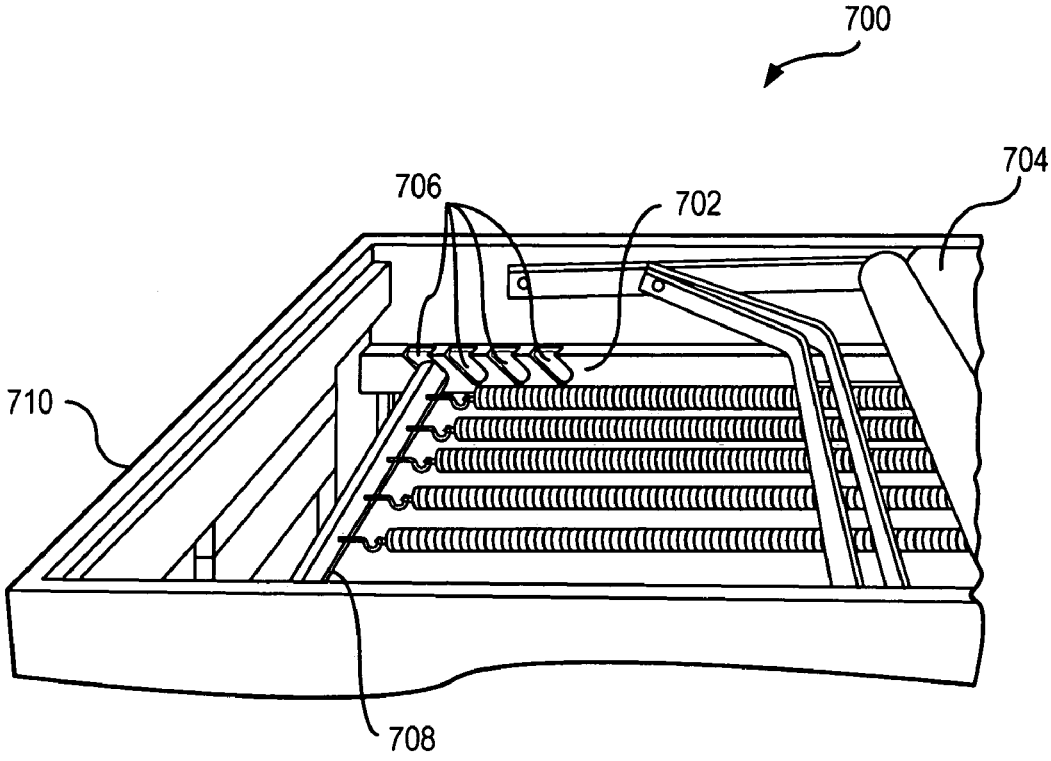
FIG. 7 is a perspective view of the foot end of an alternative reformer in accordance with the present invention similar to the apparatus shown in FIG. 1 except that a spring anchor bar is received in one pair of a series of slots in tubular tracks.
Figure 8:
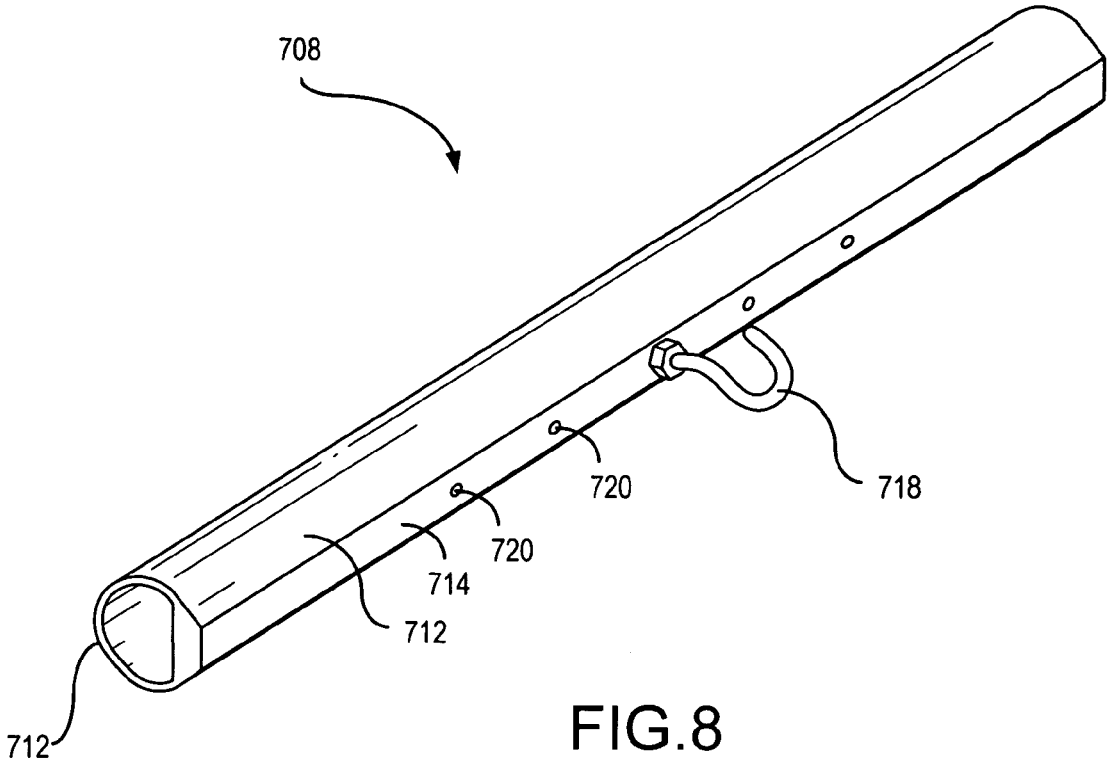
FIG. 8 is a perspective view of the non-rotating spring anchor bar in accordance with a further preferred embodiment of the present invention shown in the reformer of FIG. 7.
Figure 9:
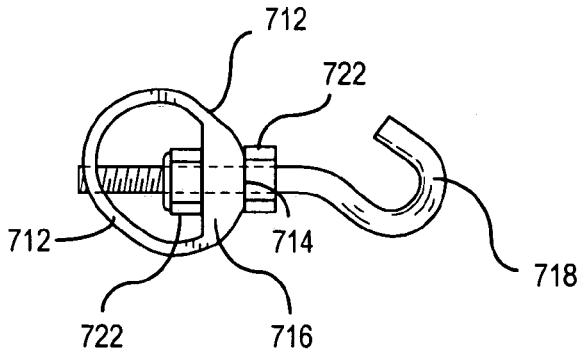
FIG. 9 is an end view of the non-rotating spring anchor bar shown in FIG. 8 in accordance with the present invention.

A further embodiment of the present invention is shown in FIGS. 7, 8 and 9. Specifically referring now to FIG. 7, the foot end of a reformer 700 is shown. In this embodiment, the reformer 700 has a pair of spaced tubular tracks 702 on which the carriage 704 rolls as in the embodiments described above. However, in this embodiment 700, the tracks 702 are formed of an extrusion having a square or rectangular tube cross-section. A series of parallel slanted slots 706 are cut through portions of the top and inner sidewalls of the tubular track 702. This configuration eliminates the need for an anchor bar support bracket as in the embodiments shown in FIGS. 1–6. An anchor bar 708 in accordance with the present invention is slip fit into one of these pairs of slots 706 near the foot end 710 of the reformer 700. This configuration of the tracks 702, each formed from a single tubular member, with slots near the foot end 710, greatly simplifies construction of the reformer as well as simplifying operational adjustment of the anchor bar.

A separate perspective view of the anchor bar 708 is shown in FIG. 8. The anchor bar 708 is a tubular member, preferably an aluminum extrusion, having two parallel opposite sides 712 that are spaced apart by a distance slightly less than the width of the slots 706 so that each of the bar ends can slip down into one of the slots 706. The outer shape of the anchor bar 708 is generally an oval shape with two parallel opposite sides 712. When installed in the slots 706, the sides 712 are parallel to the sides of the slots 706 such that rotation of the anchor bar 708 is operably prevented.

The anchor bar 708 also has a flat outer side surface 714 that lies perpendicular to the longitudinal direction of the tracks 702, thus facing the springs and the carriage 704. The anchor bar 708 also has a thickened wall portion 716 behind this surface 714 to support a plurality of anchors 718 which are each fastened in place in bores 720 through the portion 716 with a pair of nuts 722. The anchor bar 708 also has a series of holes (not shown) through the curved wall portion opposite the thickened portion 716 to permit access to the nuts 722 within anchor bar 708.

The specification and the drawings included herein disclose various embodiments of the present invention. However, the specification and the drawings of the present invention do not aim to disclose all variations of the reformer exercise apparatus and/or the anchor bar or all components that are used as in a reformer exercise apparatus. It is to be understood that the anchor bar of the present invention may be practiced in various exercise apparatuses other than as specifically described herein. For example, the angle of the slots in the anchor bar support brackets or, in the case of the embodiment shown in FIG. 7, the slots in the track members 702, may be different in other reformers than that illustrated, and thus the placement of anchor hooks or other attachment devices may be different from those shown. In one alternative, the mid portion may simply be a rod over which hooks on the ends of the springs may be attached. The hooks may be replaced with eyes or vertical posts, etc. The oval cross section of the end portion may also be changed so long as its shape interferes with rotation of the bar in the slots 148 or 706. Numerous other changes may be made which will readily suggest themselves to those skilled in the art and which are encompassed in the spirit of the invention disclosed and as defined in the appended claims.

What is claimed is:

1. A reformer exercise apparatus comprising:

a generally rectangular frame formed by a foot end and a head end connected to two spaced-apart parallel track members;

a movable carriage mounted on the rail members for supporting a user and for movement along the rails and biased toward the foot end of the frame by an elastic member;

a pair of spaced-apart anchor bar supports fastened to the frame near the foot end, each support having a series of slanted slots having a bottom wall portion joining a pair of spaced parallel sidewall portions; and an elongated elastic member anchor bar having a central axis, mid portion and a pair of bar ends, each bar end being received within one of the slots in each bracket, each bar end having a pair of parallel sides preventing rotation of the anchor bar within the slot.

2. The reformer exercise apparatus of claim 1, wherein the anchor bar is a hollow tube having an oval outer cross-sectional shape.

3. The reformer exercise apparatus of claim 2, wherein the anchor bar has a thickened wall portion.

4. The reformer exercise apparatus of claim 3, wherein the thickened portion supports one or more anchor members fastened to the anchor bar.

5. The reformer exercise apparatus of claim 1, wherein the anchor bar supports are formed in the track members.

6. The reformer exercise apparatus of claim 5 wherein each of the track members is a rectangular extrusion having a plurality of parallel slanted slots therein forming the anchor bar supports to receive the anchor bar ends.

7. An elongated elastic member anchor bar for use in a reformer exercise apparatus having a generally rectangular frame formed by a pair of spaced-apart parallel side frame members joining a head end and a foot end, the frame having a pair of spaced-apart anchor bar supports fastened to the frame near the foot end, each support having a series of upwardly open slanted slots, the elongated anchor bar having a longitudinal axis and comprising:

an extrusion having bar ends and having a generally oval cross sectional shape having two opposite side portions, wherein the side portions at the bar ends prevent angular rotation of the anchor bar about its longitudinal axis when the bar ends are received within a pair of the slots.

8. The anchor bar of claim 7 further comprising a thickened wall portion receiving a plurality of anchor members thereon.

9. The anchor bar of claim 8, wherein thickened portion has an outer flat surface facing away from the foot end of the frame when the bar is positioned in the pair of slots.

10. The anchor bar of claim 7 wherein the opposite side portions are parallel.

11. A reformer exercise apparatus comprising:

a generally rectangular frame formed by a foot end and a head end connected to two spaced-apart parallel track members;

a movable carriage mounted on the rail members for supporting a user and for movement along the rails and biased toward the foot end of the frame by an elastic member;

a pair of spaced-apart anchor bar supports formed in the rails near the foot end, each support having a spaced series of U shaped slanted slots having a curved bottom wall portion joining a pair of spaced parallel sidewall portions; and an elongated elastic member anchor bar having a pair of bar ends, each bar end being received within one of the slots in each support, each bar end having a pair of parallel sides, wherein at least one of the parallel sides engages one of the sidewall portions to prevent substantial rotation of the anchor bar within the slot.

12. The reformer exercise apparatus of claim 11, wherein the anchor bar is a hollow tube having an oval outer cross-sectional shape.

13. The reformer exercise apparatus of claim 12, wherein the anchor bar has a thickened wall portion.

14. The reformer exercise apparatus of claim 13, wherein the thickened portion supports one or more anchor members fastened to the anchor bar.

15. The reformer exercise apparatus of claim 14 wherein the thickened portion is vertical when the bar is positioned in one of the pairs of slanted slots in the rails.

16. The reformer exercise apparatus of claim 11 wherein both parallel sides of the bar ends engage the sidewall portions to prevent rotation of the anchor bar within the slanted slot.

* * * * *